US006662515B2

(12) United States Patent
Buhrts et al.

(10) Patent No.: US 6,662,515 B2
(45) Date of Patent: Dec. 16, 2003

(54) SYNTHETIC WOOD POST CAP

(75) Inventors: Bryan K. Buhrts, Reynoldsburg, OH (US); Kevin T. Burt, Columbus, OH (US); William G. Taylor, Columbus, OH (US)

(73) Assignee: Crane Plastics Company LLC, Columbus, OH (US)

( * ) Notice: Subject to any disclaimer, the term of this patent is extended or adjusted under 35 U.S.C. 154(b) by 0 days.

(21) Appl. No.: 09/824,463

(22) Filed: Apr. 2, 2001

(65) Prior Publication Data

US 2002/0066248 A1 Jun. 6, 2002

Related U.S. Application Data

(60) Provisional application No. 60/193,711, filed on Mar. 31, 2000.

(51) Int. Cl.[7] ..... E04H 12/00

(52) U.S. Cl. ..... 52/301; 52/300; 52/737.3; 52/737.4; 52/738.1; 256/1; 256/19; 256/50; 256/66; 256/DIG. 5

(58) Field of Search ..... 52/301, 300, 726.4, 52/726.3, 737.3, 737.4, 738.1; 256/1, 19, 50, 59, 66, DIG. 5

(56) References Cited

U.S. PATENT DOCUMENTS

| | | | | |
|---|---|---|---|---|
| 1,964,657 | A | * | 6/1934 | Austin |
| 2,188,396 | A | | 1/1940 | Semon |
| 2,489,373 | A | | 11/1949 | Gilman |
| 2,519,442 | A | | 8/1950 | Delorme et al. |
| 2,558,378 | A | | 6/1951 | Petry |
| 2,635,976 | A | | 4/1953 | Meiler et al. |
| 2,680,102 | A | | 6/1954 | Becher |
| 2,789,903 | A | | 4/1957 | Lukman et al. |
| 2,935,763 | A | | 5/1960 | Newman et al. |
| 3,256,659 | A | * | 6/1966 | Dudoff |
| 3,287,480 | A | | 11/1966 | Wechsler et al. |
| 3,308,218 | A | | 3/1967 | Etal |
| 3,309,444 | A | | 3/1967 | Schueler |
| 3,492,388 | A | | 1/1970 | Inglin-Knüsel |
| 3,493,527 | A | | 2/1970 | Schueler |
| 3,562,373 | A | | 2/1971 | Logrippo |
| 3,645,939 | A | | 2/1972 | Gaylord |

(List continued on next page.)

FOREIGN PATENT DOCUMENTS

| | | |
|---|---|---|
| DE | 2042176 | 4/1971 |
| DE | 3801574 | 8/1989 |

(List continued on next page.)

OTHER PUBLICATIONS

Bendtsen et al., Mechanical Properties of Wood, pp. 4–2 to 4–44.

Bibliography of Solid Phase Extrusion, pp. 187–195.

Brzoskowski et al., Air–Lubricated Die for Extrusion of Rubber Compounds, Rubber Chemistry and Technology, vol. 60, pp. 945–956.

(List continued on next page.)

*Primary Examiner*—Carl D. Friedman
*Assistant Examiner*—Yvonne M. Horton
(74) *Attorney, Agent, or Firm*—Standley Law Group LLP

(57) ABSTRACT

A post cap comprising a roof portion, at least one support member, and a wall portion. The roof portion is adapted to extend over a top portion of a post. The support member(s) extend from the roof portion to rest against the top portion of the post such that the roof portion is supported. The wall portion also extends from the roof portion. The wall portion is adapted to fit around the outside of the post. The post can be made by injection molding a synthetic wood composition.

19 Claims, 3 Drawing Sheets

U.S. PATENT DOCUMENTS 3,671,615 A 6/1972 Price
3,864,201 A 2/1975 Susuki et al.
3,867,493 A 2/1975 Seki
3,878,143 A 4/1975 Baumann et al.
3,879,505 A 4/1975 Boutillier et al.
3,888,810 A 6/1975 Shinomura
3,899,559 A 8/1975 Johnanson et al.
3,922,328 A 11/1975 Johnson
3,931,384 A 1/1976 Forquer et al.
3,943,079 A 3/1976 Hamed
3,954,555 A 5/1976 Kole et al.
3,956,541 A 5/1976 Pringle
3,956,555 A 5/1976 McKean
3,969,459 A 7/1976 Fremont et al.
4,005,162 A 1/1977 Bucking
4,012,348 A 3/1977 Chelland et al.
4,016,232 A 4/1977 Pringle
4,016,233 A 4/1977 Pringle
4,018,722 A 4/1977 Baker
4,029,831 A 6/1977 Daunheimer
4,045,603 A 8/1977 Smith
4,056,591 A 11/1977 Goettler et al.
4,058,580 A 11/1977 Flanders
4,071,479 A 1/1978 Broyde et al.
4,071,494 A 1/1978 Gaylord
4,097,648 A 6/1978 Pringle
4,102,106 A 7/1978 Golder et al.
4,107,110 A 8/1978 Lachowicz et al.
4,115,497 A 9/1978 Halmø et al.
4,145,389 A 3/1979 Smith
4,157,415 A 6/1979 Lindenberg
4,168,251 A 9/1979 Schinzel et al.
4,178,411 A 12/1979 Cole et al.
4,181,764 A 1/1980 Totten
4,187,352 A 2/1980 Klobbie
4,191,798 A 3/1980 Schumacher et al.
4,203,876 A 5/1980 Dereppe et al.
4,228,116 A 10/1980 Colombo et al.
4,239,679 A 12/1980 Rolls et al.
4,241,133 A 12/1980 Lund et al.
4,244,903 A 1/1981 Schnause
4,248,743 A 2/1981 Goettler
4,248,820 A 2/1981 Haataja
4,250,222 A 2/1981 Mavel et al.
4,263,184 A 4/1981 Leo et al.
4,263,196 A 4/1981 Schumacher et al.
4,272,577 A 6/1981 Lyng
4,273,688 A 6/1981 Porzel et al.
4,277,428 A 7/1981 Luck et al.
4,290,988 A 9/1981 Nopper et al.
4,303,019 A 12/1981 Haataja et al.
4,305,901 A 12/1981 Prince et al.
4,317,765 A 3/1982 Gaylord
4,323,625 A 4/1982 Coran et al.
4,376,144 A 3/1983 Goettler
4,382,108 A 5/1983 Carroll et al.
4,382,758 A 5/1983 Nopper et al.
4,393,020 A 7/1983 Li et al.
4,414,267 A 11/1983 Coran et al.
4,420,351 A 12/1983 Lussi et al.
4,430,468 A 2/1984 Schumacher
4,440,708 A 4/1984 Haataja et al.
4,480,061 A 10/1984 Coughlin et al.
4,481,701 A 11/1984 Hewitt
4,491,553 A 1/1985 Yamada et al.
4,503,115 A 3/1985 Hemels et al.
4,505,869 A 3/1985 Nishibori
4,506,037 A 3/1985 Suzuki et al.
4,508,595 A 4/1985 Gåsland
4,562,218 A 12/1985 Fornadel et al.
4,594,372 A 6/1986 Natov et al.
4,597,928 A 7/1986 Terentiev et al.
4,610,900 A 9/1986 Nishibori
4,645,631 A 2/1987 Hegenstaller et al.
4,659,754 A 4/1987 Edwards et al.
4,663,225 A 5/1987 Farley et al.
4,687,793 A 8/1987 Motegi et al.
4,717,742 A 1/1988 Beshay
4,722,514 A * 2/1988 Pettit ..... 256/50
4,734,236 A 3/1988 Davis
4,737,532 A 4/1988 Fujita et al.
4,746,688 A 5/1988 Bistak et al.
4,769,109 A 9/1988 Tellvik et al.
4,769,274 A 9/1988 Tellvik et al.
4,783,493 A 11/1988 Motegi et al.
4,789,604 A 12/1988 van der Hoeven
4,790,966 A 12/1988 Sandberg et al.
4,791,020 A 12/1988 Kokta
4,801,495 A 1/1989 van der Hoeven
4,818,604 A 4/1989 Tock
4,820,749 A 4/1989 Beshay
4,851,458 A 7/1989 Hopperdietzel
4,865,788 A 9/1989 Davis
4,889,673 A 12/1989 Takimoto
4,894,192 A 1/1990 Warych
4,915,764 A 4/1990 Miani
4,927,572 A 5/1990 van der Hoeven
4,927,579 A 5/1990 Moore
4,935,182 A 6/1990 Ehner et al.
4,960,548 A 10/1990 Ikeda et al.
4,968,463 A 11/1990 Levasseur
4,973,440 A 11/1990 Tamura et al.
4,978,489 A 12/1990 Radvan et al.
4,988,478 A 1/1991 Held
5,002,713 A 3/1991 Palardy et al.
5,008,310 A 4/1991 Beshay
5,009,586 A 4/1991 Pallmann
5,049,334 A 9/1991 Bach
5,057,167 A 10/1991 Gersbeck
5,064,592 A 11/1991 Ueda et al.
5,075,057 A 12/1991 Hoedl
5,075,359 A 12/1991 Castagna et al.
5,078,937 A 1/1992 Eela
5,082,605 A 1/1992 Brooks et al.
5,087,400 A 2/1992 Theuveny
5,088,910 A 2/1992 Goforth et al.
5,096,046 A 3/1992 Goforth et al.
5,096,406 A 3/1992 Brooks et al.
5,120,776 A 6/1992 Raj et al.
5,153,241 A 10/1992 Beshay
5,194,461 A 3/1993 Bergquist et al.
5,219,634 A 6/1993 Aufderhaar
5,272,000 A 12/1993 Chenoweth et al.
5,276,082 A 1/1994 Forry et al.
5,288,772 A 2/1994 Hon
5,302,634 A 4/1994 Mushovic
5,369,147 A 11/1994 Mushovic
5,393,536 A 2/1995 Brandt et al.
5,406,768 A 4/1995 Giuseppe et al.
5,419,536 A * 5/1995 Bender ..... 256/1
5,421,556 A * 6/1995 Dodge et al. ..... 256/1
5,422,170 A 6/1995 Iwata et al.
5,435,954 A 7/1995 Wold
5,441,801 A 8/1995 Deaner et al.
5,458,834 A 10/1995 Faber et al.
5,474,722 A 12/1995 Woodhams
5,480,602 A 1/1996 Nagaich
5,486,553 A 1/1996 Deaner et al.
5,497,594 A 3/1996 Giuseppe et al.
5,516,472 A 5/1996 Laver
5,518,677 A 5/1996 Deaner et al.

| | | | | |
|---|---|---|---|---|
| 5,532,065 | A | | 7/1996 | Gübitz |
| 5,537,789 | A | | 7/1996 | Minke et al. |
| 5,539,027 | A | | 7/1996 | Deaner et al. |
| 5,576,374 | A | | 11/1996 | Betso et al. |
| 5,585,155 | A | | 12/1996 | Heikkila et al. |
| 5,593,625 | A | | 1/1997 | Riebel et al. |
| 5,695,874 | A | | 12/1997 | Deaner et al. |
| 5,773,138 | A | | 6/1998 | Seethamraju et al. |
| 5,783,125 | A | | 7/1998 | Bastone et al. |
| 5,827,462 | A | | 10/1998 | Brandt et al. |
| 5,827,607 | A | | 10/1998 | Deaner et al. |
| 5,836,128 | A | | 11/1998 | Groh et al. |
| 5,853,167 | A | * | 12/1998 | West et al. ..... 256/66 |
| 5,866,264 | A | | 2/1999 | Zehner et al. |
| 5,882,564 | A | | 3/1999 | Puppin |
| 5,932,334 | A | | 8/1999 | Deaner et al. |
| 5,948,505 | A | | 9/1999 | Puppin |
| 5,948,524 | A | | 9/1999 | Seethamraju et al. |
| 5,981,067 | A | | 11/1999 | Seethamraju et al. |
| 5,985,429 | A | | 11/1999 | Plummer et al. |
| 6,004,668 | A | | 12/1999 | Deaner et al. |
| 6,007,656 | A | | 12/1999 | Heikkila et al. |
| 6,011,091 | A | | 1/2000 | Zehner |
| 6,015,611 | A | | 1/2000 | Deaner et al. |
| 6,015,612 | A | | 1/2000 | Deaner et al. |
| 6,035,588 | A | | 3/2000 | Zehner et al. |
| 6,054,207 | A | | 4/2000 | Finley |
| 6,103,791 | A | | 8/2000 | Zehner |
| 6,106,944 | A | | 8/2000 | Heikkila et al. |
| 6,117,924 | A | | 9/2000 | Brandt |
| 6,122,877 | A | | 9/2000 | Hendrickson et al. |
| 6,131,355 | A | | 10/2000 | Groh et al. |
| 6,138,422 | A | * | 10/2000 | Wall et al. ..... 52/300 |
| 6,153,293 | A | | 11/2000 | Dahl et al. |
| 6,176,462 | B1 | * | 1/2001 | Jansen ..... 249/3 |
| 6,180,257 | B1 | | 1/2001 | Brandt et al. |
| 6,210,616 | B1 | | 4/2001 | Suwanda |
| 6,210,792 | B1 | | 4/2001 | Seethamraju et al. |
| 6,265,037 | B1 | | 7/2001 | Godavarti et al. |
| 6,280,667 | B1 | | 8/2001 | Koenig et al. |
| 6,284,098 | B1 | | 9/2001 | Jacobsen |
| 6,295,778 | B1 | | 10/2001 | Burt |
| 6,337,138 | B1 | | 1/2002 | Zehner |
| 6,344,504 | B1 | | 2/2002 | Zehner et al. |
| 6,346,160 | B1 | | 2/2002 | Puppin |
| 6,357,197 | B1 | | 3/2002 | Serino et al. |
| 6,358,585 | B1 | | 3/2002 | Wolff |
| 6,360,508 | B1 | | 3/2002 | Pelfrey et al. |
| 6,409,952 | B1 | | 6/2002 | Hacker et al. |
| 6,423,257 | B1 | | 7/2002 | Stobart et al. |
| 6,453,630 | B1 | | 9/2002 | Buhrts et al. |
| 6,464,913 | B1 | | 10/2002 | Korney, Jr. |

FOREIGN PATENT DOCUMENTS

| | | |
|---|---|---|
| DE | 4033849 | 10/1990 |
| DE | 4221070 | 12/1993 |
| EP | 0269470 | 1/1988 |
| EP | 0586211 | 3/1994 |
| EP | 0586212 | 3/1994 |
| EP | 0586213 | 3/1994 |
| EP | 0747419 | 12/1996 |
| FR | 2270311 | 2/1974 |
| FR | 2365017 | 4/1978 |
| FR | 2445885 | 8/1980 |
| FR | 2564374 | 11/1985 |
| GB | 1443194 | 7/1976 |
| GB | 2036148 | 6/1980 |
| GB | 2104903 | 3/1983 |
| GB | 2171953 | 9/1986 |
| GB | 2186655 | 8/1987 |
| WO | WO 90/08020 | 7/1990 |

OTHER PUBLICATIONS

Collier et al., High Strength Extrudates by Melt Transformation Coextrusion, ANTEC, 1987, pp. 497–502.

Collier et al., Streamlined Dies and Profile Extrusion, ANTEC, 1987, pp. 203–206.

Company News, Plastics Industry News, May 1994, pp. 70–71.

Dalväg et al., The Efficiency of Cellulosic Fillers in Common Thermoplastics. Part II. Filling with Processing Aids and Coupling Agents, 1985, vol. 11, pp. 9–38.

Fiberloc Polymer Composites, B.F. Goodrich, Geon Vinyl Division, section 1, pp. 2–15.

Fill Thermoplastics with Wood, Modern Plastics, May 1974, pp. 54–55.

Fillers for Thermoplastics: Beyond Resin Stretching, Modern Plastics International, Oct. 1976, pp. 12–15.

From Sweden: Extruded Interior Trim Made of PVC and Wood Flour, Plastic Building Construction, vol. 9, No. 5, 1986, pp. 5–6.

Henrici–Olive et al., Integral/Structural Ploymer Foams, Technology, Properties and Applications, Springer–Verlag, pp. 111–122.

Klason et al., The Efficiency of Cellulosic Fillers in Common Thermoplastics. Part 1. Filling without Processing Aids or Coupling Agents, Polymeric Materials, 1984, vol. 10, pp. 159–187.

Kokta et al., Composites of Poly(Vinyl Chloride) and Wood Fibers. Part II: Effect of Chemical Treatment, Polymer Composites, Apr. 1990, pp. 84–89.

Kokta et al., Composites of Polyvinyl Chloride—Wood Fibers. I. Effect of Isocyanate as a Bonding Agent, Polym.—Plast. Technol. Eng., 1990, 29(1&2), pp 87–118.

Kokta et al., Composites of Polyvinyl Chloride—Wood Fibers. III: Effect of Silane as Coupling Agent, Journal of Vinyl Technology, Sep. 1990, pp. 146–153.

Kokta et al., Use of Grafted Wood Fibers in Thermoplastic Composites v. Polystyrene, Centre de recherche en pâtes et papiers, Université du Québec à Trois–Rivières, Canada.

Kokta et al., Use of Wood Fibers in Thermoplastic Composites, Polymer Composites, Oct. 1983, pp. 229–232.

Maldas et al., Composites of Polyvinyl Chloride—Wood Fibers: IV. Effect of the Nature of Fibers, Journal of Vinyl Technology, Jun. 1989, pp. 90–98.

Maldas, et al., Improving Adhesion of Wood Fiber with Polystrene by the Chemical Treatment of Fiber with a Coupling Agent and the Influence on the Mechanical Properties of Composites, Journal of Adhesion Science Technology, vol. 3 No. 7, pp. 529–539 (1989).

Myers et al., "Wood flour and polypropylene or high–density polyethylene composites: influence of maleated polypropylene concentration and extrusion temperature on properties", "Wood Fiber/Polymer Composites: Fundamental Concepts, Processes, and Material Options", pp. 49–56.

Myers et al., Bibliography: Composites from Plastics and Wood–Based Fillers, USDA Forest Products Laboratory, Madison, WI, pp. 1–27 odds (1991).

Myers et al., Effects of Composition and Polypropylene Melt Flow on Polypropylene—Waste Newspaper Composites, ANTEC, 1984, pp. 602–604.

Pornnimit et al., Extrusion of Self–Reinforced Polyethylene, Advances in Polymer Technology, vol. 11, No. 2, pp. 92–98.

Raj et al., Use of Wood Fiber as Filler in Common Thermoplastics: Studies on Mechanical Properties, Science and Engineering of Composite Materials, vol. 1 No. 3, 1989, pp. 85–98.
Raj et al., Use of Wood Fibers in Thermoplastics. VII. The Effect of Coupling Agents in Polyethylene—Wood Fiber Composites, Journal of Applied Polymer Science, vol. 37, pp. 1089–1103 (1989).
Resin Stretching: Accent on Performance, Modern Plastic International, Jan. 1974, pp. 58–60.
Rogalski et al., Poly(Vinyl–Chloride) Wood Fiber Composites, ANTEC, 1987, pp. 1436–1441.
Sonwood Outline, Apr., 1975.
Sonwood: a new PVC wood–flour alloy for Extrusions and other Plastic Processing Techniques, Sonesson Plast AB, Malmo, Sweden.
Thomas et al., Wood Fibers for Reinforcing Fillers for Polyolefins, ANTEC, 1984, pp. 687–689.
Wood Filled PVC, Plastics Industry News, Jul. 1996, p. 6.
Woodhams et al., Wood Fibers for Reinforcing Fillers for Polyolefins, Polymer Engineering and Science, Oct. 1984, pp. 1166–1171.
Yam et al., Composites from Compounding Wood Fibers With Recycled High Density Polyethylene, Polymer Engineering and Science, mid–Jun. 1990, pp. 693–699, vol. 30, No. 11.
Yuskova, et al., Interaction of Components in Poly(Vinyl Choloride) Filled in Polymetization, Makroniol Chem., Macromol. Symp. 29, 315–320 (1989).
Zadorecki et al., Future Prospects for Wood Cellulose as Reinforcement In Organic Polymer Composites, Polymer Composites, Apr. 1989, pp. 69–77.

* cited by examiner

SYNTHETIC WOOD POST CAP

This Application claims the benefit of U.S. Provisional Application No. 60/193,711, filed Mar. 31, 2000. The entirety of U.S. Provisional Application No. 60/193,711 is hereby incorporated by reference.

BACKGROUND AND SUMMARY OF THE INVENTION

The present invention relates generally to posts and, more particularly, to a synthetic wood cap that is adapted to fit a post. A preferred use of the cap is to fit a wood or synthetic wood deck post. However, it is believed that the patentability of the present invention is not dependent on the composition of the cap or the use, type, or composition of the post. The cap of the present invention may be made from a variety of materials, and it may be used to fit any suitable post regardless of its type, use, or composition.

Posts serve a variety of purposes. For example, a post may be used as a support in a deck railing system, a fencing system, or other types of barrier systems. On the other hand, a post may be a solitary member that is used as a support, e.g., a mailbox post, or that is used to block or define a path. In addition, it should be recognized that posts serve many other different uses.

In a typical use of a post, one end of the post is secured to a foundation, e.g., a deck or the ground, and the other end of the post is elevated above the foundation. The end of the post that is elevated above the foundation is usually visible. Accordingly, it is desired to make that end of the post aesthetically pleasing. For this purpose, the end of the post can be shaped or finished such that it is in desired condition. Alternatively, it is desirable to place a cap over the end of the post to provide a desired visual appearance. In this manner, a cap can significantly limit the time and expense of shaping and finishing the end of the post.

A cap can also provide other benefits. The end of the post is susceptible to damage, particularly if it is made from wood or synthetic wood. For example, rainwater can settle on the end of the post and cause it to deteriorate if it is uncovered. A cap can substantially eliminate this type of damage.

A cap can also prevent damage to hollow posts. An extruded, synthetic wood post may be hollow. As a result of being hollow, rainwater, insects, and other debris can enter the hollow end of the post if it is not covered. This can result in various types of damage to the post. Accordingly, it is desirable to fit a cap on the end of a hollow post to keep out rainwater, insects, and other debris.

The present invention provides a cap that fulfills some or all of these needs. In particular, the present invention provides a cap that is adapted to fit securely on a post. A preferred embodiment of the cap is comprised of a synthetic wood composition that has been injection molded to obtain the desired shape and characteristics. The cap is preferably secured to the post by an adhesive and/or spacers.

In addition to the novel features and advantages mentioned above, other objects and advantages of the present invention will be readily apparent from the following descriptions of the drawings and preferred embodiments.

DETAILED DESCRIPTION OF PREFERRED EMBODIMENT(S)

Figure 1:
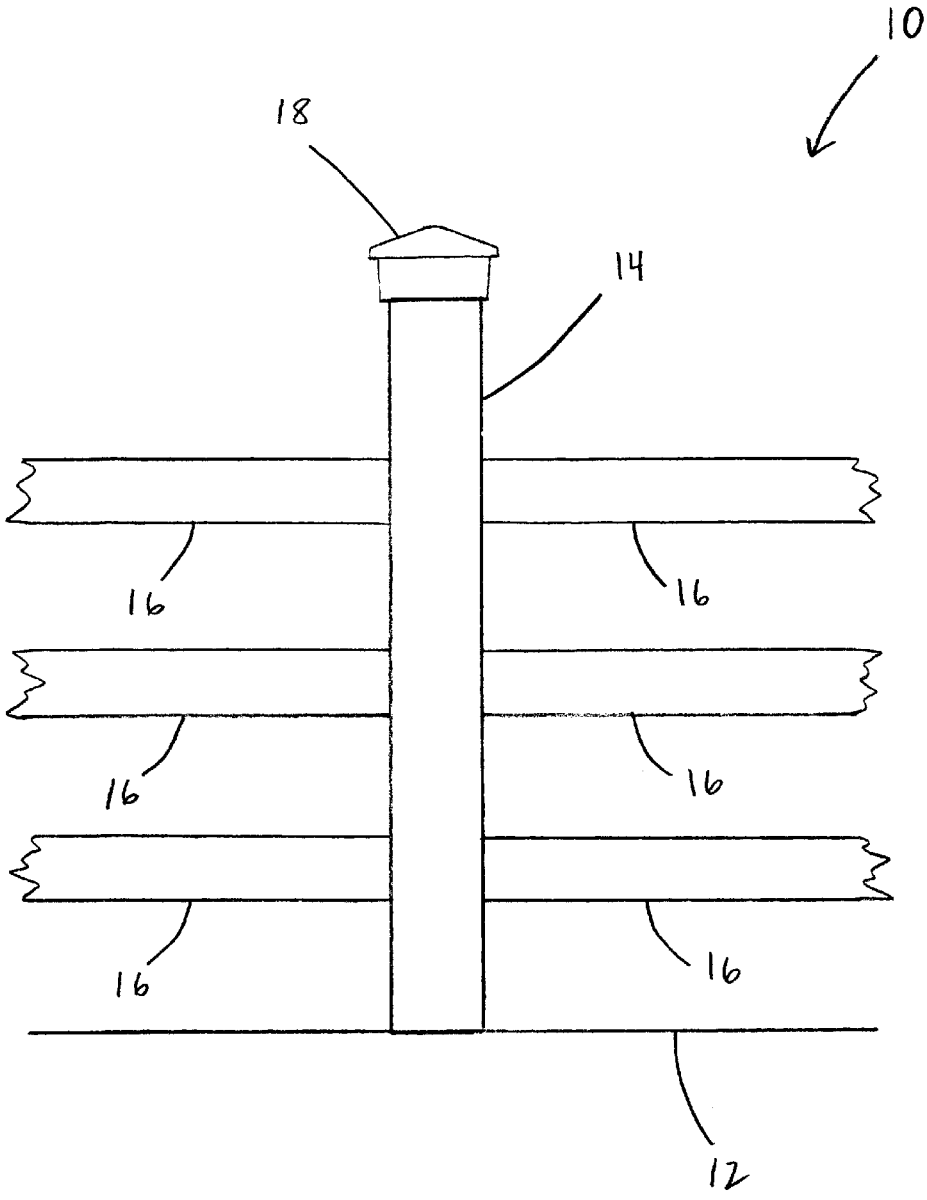
FIG. 1 is a side elevation view of a preferred embodiment of a cap of the present invention installed on a deck post of a deck railing system.

The present invention is directed primarily to a synthetic wood post cap. The present invention also includes systems that use the post cap as well as methods of manufacturing and using the post cap. A preferred implementation of the post cap is illustrated in FIG. 1. FIG. 1 is a partial view of an exemplary deck railing system 10. The deck railing system 10 extends around a deck 12. The deck railing system 10 preferably includes a plurality of deck posts 14 and rails 16. The deck posts 14 may be hollow or solid. The rails 16 extend between the deck posts 14. The deck posts 14 and rails 16 may be comprised of a synthetic wood composition. For example, the deck posts 14 and rails 16 may be made from a TIMBERTECH® composition made by TimberTech Limited of Columbus, Ohio. However, it should be recognized that the deck posts 14 and rails 16 may be made from any other suitable material such as, but not limited to, metal, wood, or other plastic formulations.

The deck railing system 10 also includes a plurality of caps 18 of the present invention. In this example, a preferred embodiment of a cap 18 is fitted on each deck post 14. In particular, a cap 18 fits around the outside of the deck post 14 regardless of whether the deck post 14 is hollow or solid. However, in alternative embodiments, it should be recognized that a cap may fit around the inside of a hollow deck post.

It is preferred that the cap 18 fits securely on the end of the deck post 14. A secure fit preferably prevents the cap 18 from being knocked off of the deck post 14. In addition, it preferably keeps rainwater, insects, and other debris from entering the inside of a hollow deck post 14, settling on top of a solid deck post 14, or invading the top of a solid deck post 14. Any appropriate means may be used to secure the cap 18 to the deck post 14. For example, nails, screws, pins, clamps, and/or other appropriate mechanical fastening means may be used to secure the cap 18 to the deck post 14. Alternatively, an adhesive such as, but not limited to, an epoxy may be used alone or in conjunction with mechanical fastening means to secure the cap 18 to the deck post 14. It should also be understood that one or more spacers may be used if the cap 18 does not fit snugly around the deck post 14. The spacer(s) may be used alone or in conjunction with an adhesive and/or mechanical fastening means to fit the cap 18 on the deck post 14. In particular, a spacer may be comprised of one or more pieces of material that are adapted to be positioned and/or wedged between the cap 18 and the deck post 14 in order to achieve a desired fit. The spacer may be comprised of any appropriate material such as, but not limited to, wood, synthetic wood, plastic, metal, or any other material that is suitable for this purpose.

Figure 2:
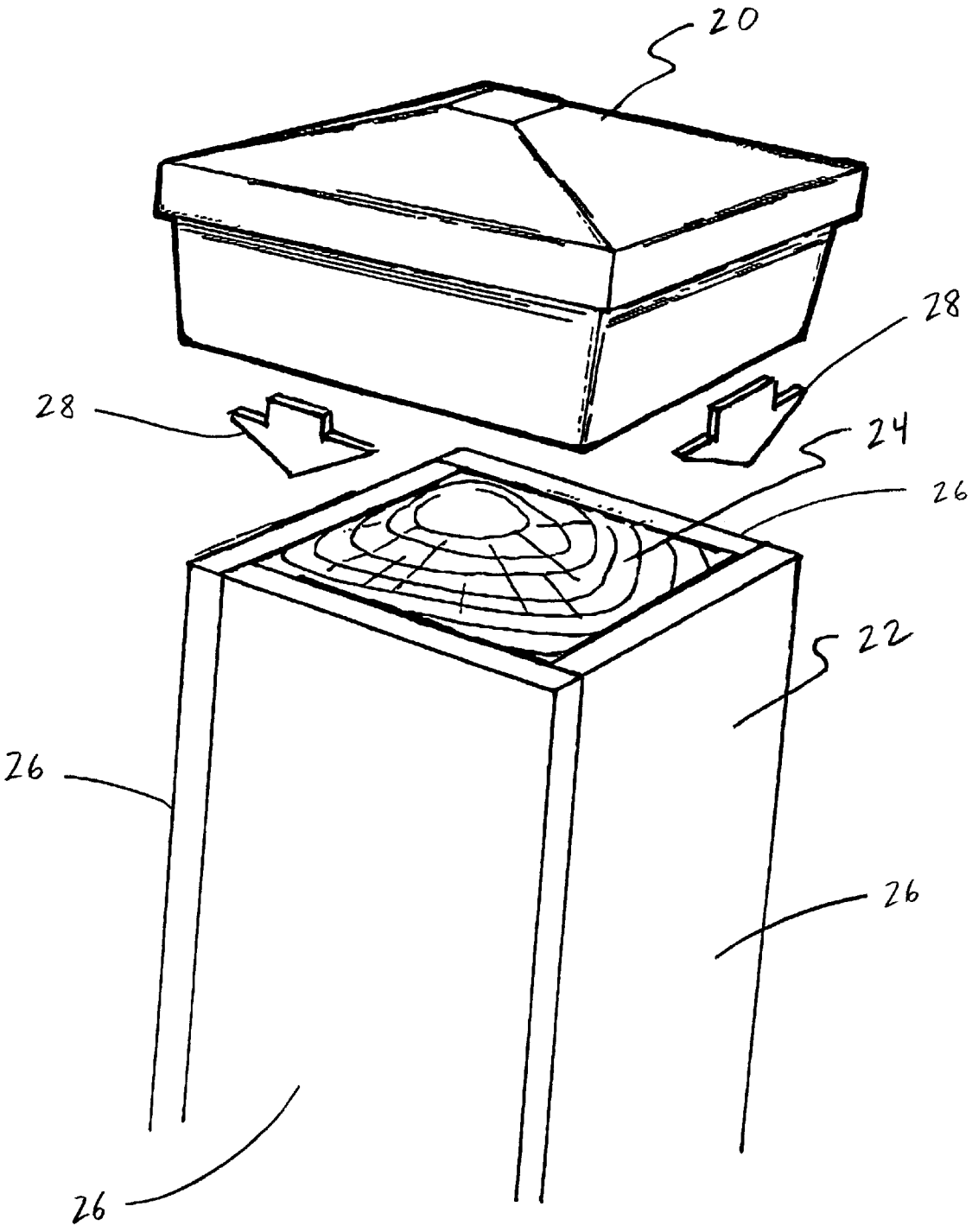
FIG. 2 is a perspective view showing how another preferred embodiment of a cap of the present invention is fitted on a deck post.

FIG. 2 illustrates how a preferred embodiment of the cap 20 of the present invention is fitted on one embodiment of a deck post 22. In this example, the deck post 22 is comprised of an interior wood post 24 which is surrounded by multiple pieces of synthetic wood cladding 26. Any suitable, desired, or conventional synthetic wood composition may be used to make the cladding 26. An example of a synthetic wood composition is a TIMBERTECH® composition made by TimberTech Limited of Columbus, Ohio. However, it should be recognized that, in alternative embodiments, the cladding 26 may be made of other materials including, but not limited to, wood, metal, plastic, or other similar, suitable, or conventional materials. An adhesive may be distributed on the interior of the cap 20 and/or on the top of the wood post 24 and/or on the top portions of the pieces of synthetic wood cladding 26. The cap 20 is then moved in the direction indicated by the arrows 28 and fitted on the deck post 22.

Figure 4:
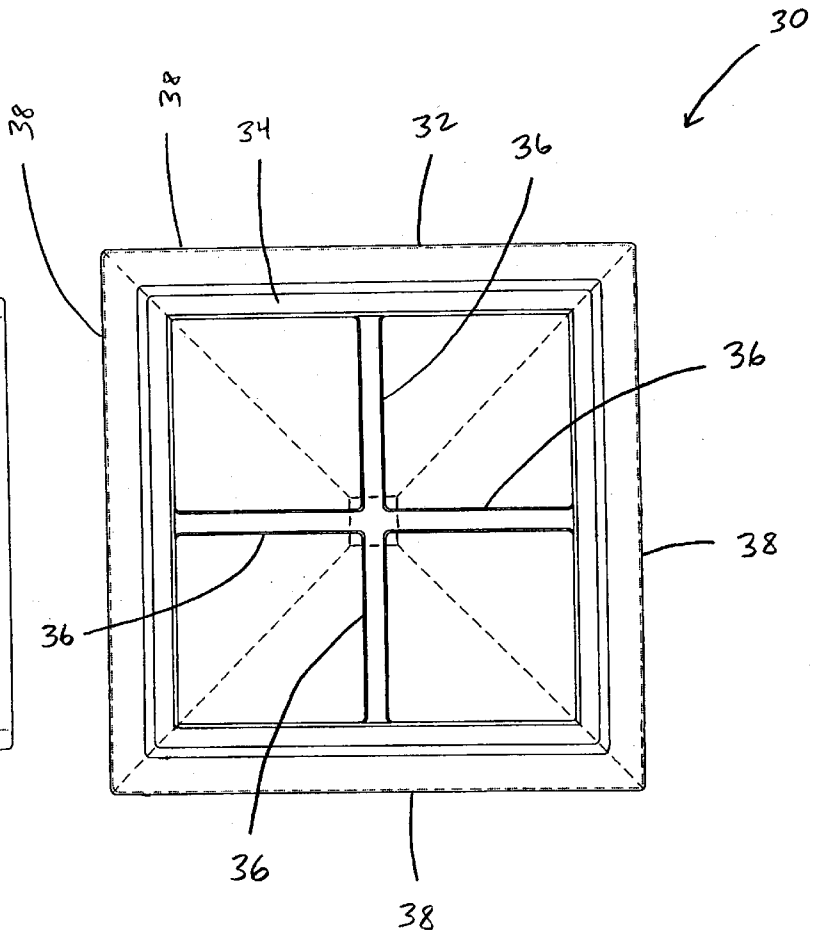
FIG. 4 is a bottom plan view of the cap of FIG. 3.
Figure 3:
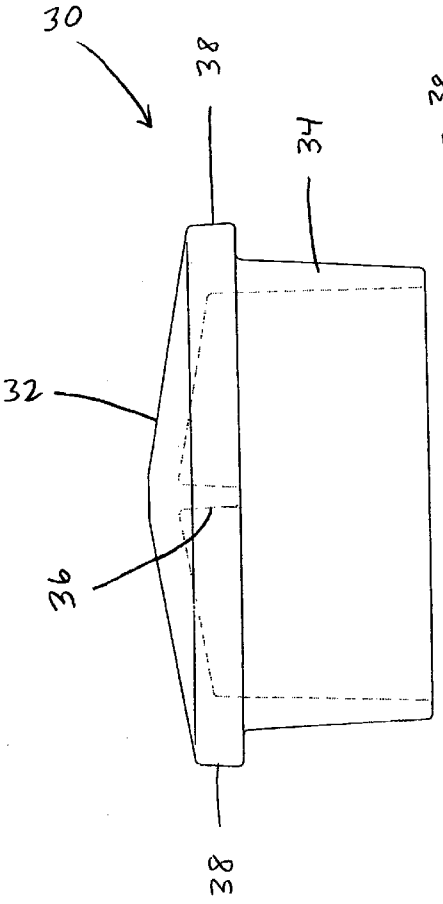
FIG. 3 is a side elevation view of still another preferred embodiment of a cap of the present invention.

FIGS. 3 and 4 are detailed drawings of another preferred embodiment of a cap 30 of the present invention. Specifically, FIG. 3 is a side elevation view of the cap 30. In FIG. 3, the broken lines indicate the interior of the cap 30 which is not visible from this viewing angle. FIG. 4, on the other hand, is a bottom plan view of the cap 30.

Referring to FIGS. 3 and 4, the cap 30 includes a roof portion 32 and a wall portion 34. In this example, the roof portion 32 has a generally pyramidal shape to help prevent rain and other debris from collecting on the top of the cap 30. However, it should be recognized that the roof portion 32 may have any desired shape. The wall portion 34 extends from the roof portion 32, and it is preferably shaped such that it provides a desired fit around the lateral sides of a post. An outer edge portion 38 of the roof portion 32 may extend outwardly beyond the wall portion 34 to promote drainage of rainwater away from the sides of the underlying post. The cap 30 also preferably includes one or more support members 36 that are adapted to support the roof portion 32. In this example, the four support members 36 are interconnected, and each extends from and bisects a respective triangular section of the roof portion 32. When the cap 30 is fitted on a deck post, it is preferred that the support members 36 rest against the top of the deck post in order to provide optimum support of the roof portion 32. Moreover, it enables an adhesive to secure the support members 36 to the top of the deck post.

A cap of the present invention may be comprised of a synthetic wood composition. Any desired synthetic wood compositions and foamed polymer compositions may be used in the present invention. For instance, the materials used to make the cap of the present invention may be virgin or recycled materials including, but not limited to, cellulosic fillers, polymers, plastics, thermoplastics, rubber, inorganic fillers, cross-linking agents, lubricants, process aids, stabilizers, accelerators, inhibitors, enhancers, compatibilizers, blowing agents, foaming agents, thermosetting materials, and other similar, suitable, or conventional materials. Examples of cellulosic fillers include sawdust, newspapers, alfalfa, wheat pulp, wood chips, wood fibers, wood particles, ground wood, wood flour, wood flakes, wood veneers, wood laminates, paper, cardboard, straw, cotton, rice hulls, coconut shells, peanut shells, bagass, plant fibers, bamboo fiber, palm fiber, kenaf, and other similar, suitable, or conventional materials. Examples of polymers include multilayer films, high density polyethylene (HDPE), polypropylene, polyvinyl chloride (PVC), low density polyethylene (LDPE), chlorinated polyvinyl chloride (CPVC), acrylonitrile butadiene styrene (ABS), ethyl-vinyl acetate (EVA), polystyrene, other similar copolymers, other similar, suitable, or conventional plastic materials, and formulations that incorporate any of the aforementioned polymers. Examples of inorganic fillers include talc, calcium carbonate, kaolin clay, magnesium oxide, titanium dioxide, silica, mica, barium sulfate, acrylics, and other similar, suitable, or conventional materials. Examples of thermosetting materials include polyurethanes, such as isocyanates, phenolic resins, unsaturated polyesters, epoxy resins, and other similar, suitable, or conventional materials. Combinations of the aforementioned materials are also examples of thermosetting materials. Examples of lubricants include zinc stearate, calcium stearate, esters, amide wax, paraffin wax, ethylene bis-stearamide, and other similar, suitable, or conventional materials. Examples of stabilizers include tin stabilizers, lead and metal soaps such as barium, calcium, and zinc, and other similar, suitable, or conventional materials. In addition, examples of process aids include acrylic modifiers and other similar, suitable, or conventional materials.

Examples of synthetic wood compositions include, but are not limited to, plastic/cellulosic filler compositions, polymer/cellulosic filler compositions, thermosetting/cellulosic filler compositions, thermoplastic/cellulosic filler compositions, rubber/cellulosic filler compositions, foamed synthetic wood compositions, inorganic-filled plastic compositions, and other synthetic wood compositions that are known now or in the future. An example of a synthetic wood composition is a TIMBERTECH® composition made by TimberTech Limited of Columbus, Ohio. For example, the composition of the cap is preferably comprised of wood flour in the amount of 30–55% by weight, zinc stearate in the amount of 0–10% by weight, ethylene bis stearamide (EBS) in the amount of 0–10% by weight, talc in the amount of 5–20% by weight, mica in the amount of 0–15% by weight, and high density polyethylene in the amount of 25–60% by weight. More preferably, the composition of the cap is comprised of wood flour in the amount of 35–45% by weight, zinc stearate in the amount of 0–5% by weight, ethylene Bis Stearamide (EBS) in the amount of 0–5% by weight, talc in the amount of 10–20% by weight, mica in the amount of 0–10% by weight, and high density polyethylene in the amount of 30–40% by weight. The blending process of the present invention is preferably comprised of drying the wood flour to about 2% or less moisture content by weight. Thereafter, the other ingredients are preferably added and then blended with the wood flour for about 5 minutes. The inventors have made the surprising discovery that the resulting composition can be injection molded at a suitable temperature in the shape of the present invention.

In alternative embodiments of the present invention, the cap can be made from other materials and compositions. For example, the cap of the present invention can be made from other known and/or conventional synthetic wood compositions. Also, the cap can be made from other plastic formulations and/or materials, e.g., wood or metal.

It should also be recognized that the manufacturing method is not limited to injection molding. The cap may be manufactured by any method that is suitable to obtain the desired characteristics of the cap.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A post cap comprising:

a roof portion adapted to extend over a top portion of a post, said roof portion having a generally pyramidal shape comprised of a plurality of triangular sections;

a plurality of interconnected support members extending from said roof portion, each support member substantially bisecting a respective triangular section of said roof portion; and a wall portion extending from said roof portion, said wall portion adapted to fit around the outside of said post.

2. The post cap of claim 1 wherein said post cap is made from a synthetic wood composition.

3. The post cap of claim 2 wherein said synthetic wood composition is adapted to be injection molded.

4. The post cap of claim 2 wherein said synthetic wood composition comprises:

cellulosic material in the amount of 30–55% by weight;

high density polyethylene in the amount of 25–60% by weight;

zinc stearate in the amount of 0–10% by weight;

ethylene bis stearamide in the amount of 0–10% by weight;

talc in the amount of 5–20% by weight; and mica in the amount of 0–15% by weight.

5. The post cap of claim 4 wherein said synthetic wood composition comprises:

cellulosic material in the amount of 35–45% by weight;

high density polyethylene in the amount of 30–40% by weight;

zinc stearate in the amount of 0–5% by weight;

ethylene bis stearamide in the amount of 0–5% by weight;

talc in the amount of 10–20% by weight; and mica in the amount of 0–10% by weight.

6. The post cap of claim 1 wherein said roof portion has an outer edge portion that extends outwardly beyond said wall portion of said post cap.

7. A post system comprising:

a wood post having a top portion and at least one lateral side;

cladding extending around said at least one lateral side of said wood post; and a post cap comprising:

a roof portion adapted to extend over said top portion of said wood post, said roof portion having a generally pyramidal shape comprised of a plurality of triangular sections; and a plurality of interconnected support members extending from said roof portion, each support member substantially bisecting a respective triangular section of said roof portion.

8. The post system of claim 7 wherein said cladding is comprised of a synthetic wood composition.

9. The post system of claim 7 wherein said post cap is comprised of a synthetic wood composition.

10. The post system of claim 9 wherein said synthetic wood composition comprises:

cellulosic material in the amount of 30–55% by weight;

high density polyethylene in the amount of 25–60% by weight;

zinc stearate in the amount of 0–10% by weight;

ethylene bis stearamide in the amount of 0–10% by weight;

talc in the amount of 5–20% by weight; and mica in the amount of 0–15% by weight.

11. The post system of claim 10 wherein said synthetic wood composition comprises:

cellulosic material in the amount of 35–45% by weight;

high density polyethylene in the amount of 30–40% by weight;

zinc stearate in the amount of 0–5% by weight;

ethylene bis stearamide in the amount of 0–5% by weight;

talc in the amount of 10–20% by weight; and mica in the amount of 0–10% by weight.

12. The post system of claim 7 wherein said post cap further comprises:

a wall portion extending from said roof portion, said wall portion extending around the outside of said cladding.

13. The post system of claim 12 wherein said roof portion has an outer edge portion that extends outwardly beyond said wall portion of said post cap.

14. The post system of claim 7 wherein at least one of said support members rests against said top portion of said wood post.

15. A method of making a post cap, said method comprising:

providing a synthetic wood composition comprising cellulosic material; and injection molding said synthetic wood composition in the shape of said post cap;

wherein said post cap has a roof portion adapted to extend over a top portion of a post, at least one support member extending from said roof portion, said at least one support member adapted to rest against said top portion of said post such that said roof portion is supported, and a wall portion extending from said roof portion, said wall portion adapted to fit around the outside of said post.

16. The method of claim 15 wherein said synthetic wood composition comprises:

said cellulosic material in the amount of 30–55% by weight;

high density polyethylene in the amount of 25–60% by weight;

zinc stearate in the amount of 0–10% by weight;

ethylene bis stearamide in the amount of 0–10% by weight;

talc in the amount of 5–20% by weight; and mica in the amount of 0–15% by weight.

17. The method of claim 16 wherein said synthetic wood composition comprises:

said cellulosic material in the amount of 35–45% by weight;

high density polyethylene in the amount of 30–40% by weight;

zinc stearate in the amount of 0–5% by weight;

ethylene bis stearamide in the amount of 0–5% by weight;

talc in the amount of 10–20% by weight; and mica in the amount of 0–10% by weight.

18. The method of claim 15 wherein said roof portion of said post cap has a generally pyramidal shape.

19. The method of claim 15 wherein said roof portion of said post cap has an outer edge portion that extends outwardly beyond said wall portion of said post cap.

* * * * *